US009765939B2

(12) United States Patent
Lee

(10) Patent No.: US 9,765,939 B2
(45) Date of Patent: Sep. 19, 2017

(54) SHIELD DRIVE DEVICE FOR HEAD LAMP

(71) Applicant: Hyundai Motor Company, Seoul (KR)

(72) Inventor: Seong Hoon Lee, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/949,684

(22) Filed: Nov. 23, 2015

(65) Prior Publication Data

US 2016/0161075 A1 Jun. 9, 2016

(30) Foreign Application Priority Data

Dec. 5, 2014 (KR) ..... 10-2014-0173603

(51) Int. Cl.
*F21V 17/02* (2006.01)
*F21S 8/10* (2006.01)

(52) U.S. Cl.
CPC ..... *F21S 48/1778* (2013.01)

(58) Field of Classification Search
CPC ..... F21S 48/1778; F21S 48/1773; F21S 48/1784; F21S 48/1789
See application file for complete search history.

(56) References Cited

U.S. PATENT DOCUMENTS

2005/0201117 A1* 9/2005 Sugimoto ..... F21S 48/1794 362/539
2010/0142216 A1* 6/2010 Huang ..... F21S 48/1773 362/512
2012/0113663 A1* 5/2012 Kim ..... F21S 48/1778 362/513
2013/0314924 A1* 11/2013 Lee ..... F21S 48/1778 362/284

FOREIGN PATENT DOCUMENTS

| | | | |
|---|---|---|---|
| CN | 203744083 | U | 7/2014 |
| JP | 09-035504 | A | 2/1997 |
| JP | 2001-319506 | A | 11/2001 |
| JP | 2010-61985 | A | 3/2010 |
| KR | 10-2010-0114804 | A | 10/2010 |
| KR | 10-2011-0072381 | A | 6/2011 |
| KR | 10-1344429 | B1 | 12/2013 |
| KR | 10-2014-0038884 | A | 3/2014 |
| KR | 10-2014-0039884 | A | 4/2014 |

* cited by examiner

*Primary Examiner* — Anabel Ton
(74) *Attorney, Agent, or Firm* — Morgan, Lewis & Bockius LLP

(57) ABSTRACT

A shield drive device for a head lamp may include a shield deployed in front of a light source positioned in a lamp assembly to be opened and closed while rotating by using a hinge portion as an axis, an actuator connected to a shield arm through a shaft while being deployed below the shield to rotate the shield, a sliding contact member deployed to be close to the shield arm of the shield to provide friction contact force when the shield rotates, and a sliding stopper and a spring mounted on the shield arm of the shield and configured to decelerate and control a motion of the shield while being compressed or de-compressed while contacting the sliding contact member when the shield rotates.

6 Claims, 7 Drawing Sheets

SHIELD DRIVE DEVICE FOR HEAD LAMP

CROSS-REFERENCE TO RELATED APPLICATION

The present application claims priority to Korean Patent Application No. 10-2014-0173603, filed Dec. 5, 2014, the entire contents of which is incorporated herein for all purposes by this reference.

BACKGROUND OF THE INVENTION

Field of the Invention

The present invention relates to a shield drive device for a head lamp, and more particularly, to a shield drive device that opens and closes a shield to drive a high beam and a low beam in a bi-functional head lamp.

Description of Related Art

In general, an illumination device is installed in a vehicle in order to stably secure a view of a driver when surrounding illumination is low while driving.

A head lamp in the illumination device is primarily used to secure a stable visual distance of the driver.

In general, the head lamp may selectively irradiate a high beam and a low beam forward according to an irradiation angle and a light amount of light irradiated from a light source and the selective irradiation of the high beam and the low beam is performed by opening and closing operations of a shield by driver's operating a switch or automatically performed by the opening and closing operations of the shield according to a driving state of the vehicle.

FIGS. 6 and 7 are a side view, a perspective view, and a front view illustrating a shield drive device in the related art.

As illustrated in FIGS. 6 and 7, an actuator 110 that actuates a shield 130 is deployed below a lamp assembly 100, the shield 130 which is foldable by a lower end hinge structure is deployed in front of a light source (not illustrated), and a plunger 140 of the actuator 110 is connected to a lower end portion of the shield 130 together with a damper 150.

Herein, undescribed reference numerals 160 and 170 represent a shield spring providing force for automatic shield closing and a noise preventing damper, respectively.

Therefore, when the shield is maintained in a closed state, the low beam may be implemented (for example as shown in various embodiments of the present invention illustrated in FIG. 1) and when the shield is maintained in an opened state, the high beam may be implemented (for example as shown in various embodiments of the present invention illustrated in FIG. 2).

However, in the shield drive device in the related art, a plunger distortion phenomenon occurs due to generation of a height difference between the actuator and a shield connection unit when the shield is opened and closed, and as a result, there is a problem in that noise is generated when the shield is driven.

For example, as illustrated in FIG. 8, while the shield 130 is closed, centers of a plunger connection unit, the damper 150, and the shield connection unit coincide with each other, distortion does not occur, but as illustrated in FIG. 9, when the shield 130 rotates while the actuator 110 is driven, the shield 130 rotates around a rotational shaft and in this case, a height difference H is generated between the plunger connection unit and the shield connection unit to cause the damper 150 to be twisted and the plunger to be distorted and consequently, such a phenomenon results in generation of the noise.

That is, when the shield is opened by driving the actuator, large noise is not generated, but while applied voltage of the actuator is cut off, when the shield is closed by spring restoration force, the large noise is generated while the noise preventing damper and the shield collide with each other.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a shield drive device of a head lamp that adopts a drive mechanism providing rotational power in the same direction as a rotational direction of a shield and implements a new type of shield driving scheme adopting a spring damper mechanism capable of a rapid motion of the shield through slide friction contact when the shield is opened and closed to significantly reduce generation of impact and noise when the shield is opened and closed and secure operational quality of the shield.

According to various aspects of the present invention, a shield drive device for a head lamp may include a shield deployed in front of a light source positioned in a lamp assembly to be opened and closed while rotating by using a hinge portion as an axis, an actuator connected to a shield arm through a shaft while being deployed below the shield to rotate the shield, a sliding contact member deployed to be close to the shield arm of the shield to provide friction contact force when the shield rotates, and a sliding stopper and a spring mounted on the shield arm of the shield and configured to decelerate and control a motion of the shield while being compressed or de-compressed while contacting the sliding contact member when the shield rotates.

The actuator may be deployed in line below the shield to provide rotational drive force in a same direction as a rotational direction of the shield.

A plurality of sliding stoppers and springs may be provided, at least one of which may be configured to decelerate and control a shield motion when the shield is opened and another of which is configured to decelerate and control the shield motion when the shield is closed.

An inclination surface having a height difference in a circumferential direction may be provided on a front surface of the sliding contact member, and as a result, a shield deceleration control may be achieved while the sliding stopper passes through an inclination surface section.

The inclination surface of the sliding contact member may comprise two inclination surfaces having a phase difference of 180° from each other and which are gradually heightened in opposite directions to each other based on the circumferential direction.

A shield drive device of a head lamp according to the present invention achieves the following effects.

First, a drive mechanism is applied, which sets a power transfer direction of an actuator and a drive direction of a shield to the same direction to completely exclude a plunger distortion problem in the related art and simply an overall structure.

Second, when the shield is opened and closed, a spring damper mechanism capable of controlling a rapid motion of the shield is applied to significantly reduce generation of noise when the shield is driven.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
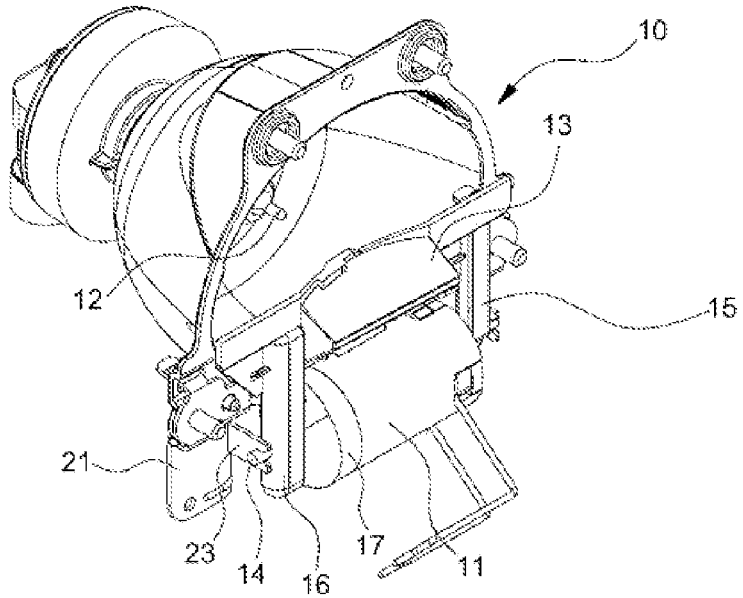
FIG. 1 is a combinational perspective view illustrating an exemplary shield drive device according to the present invention.
Figure 2:
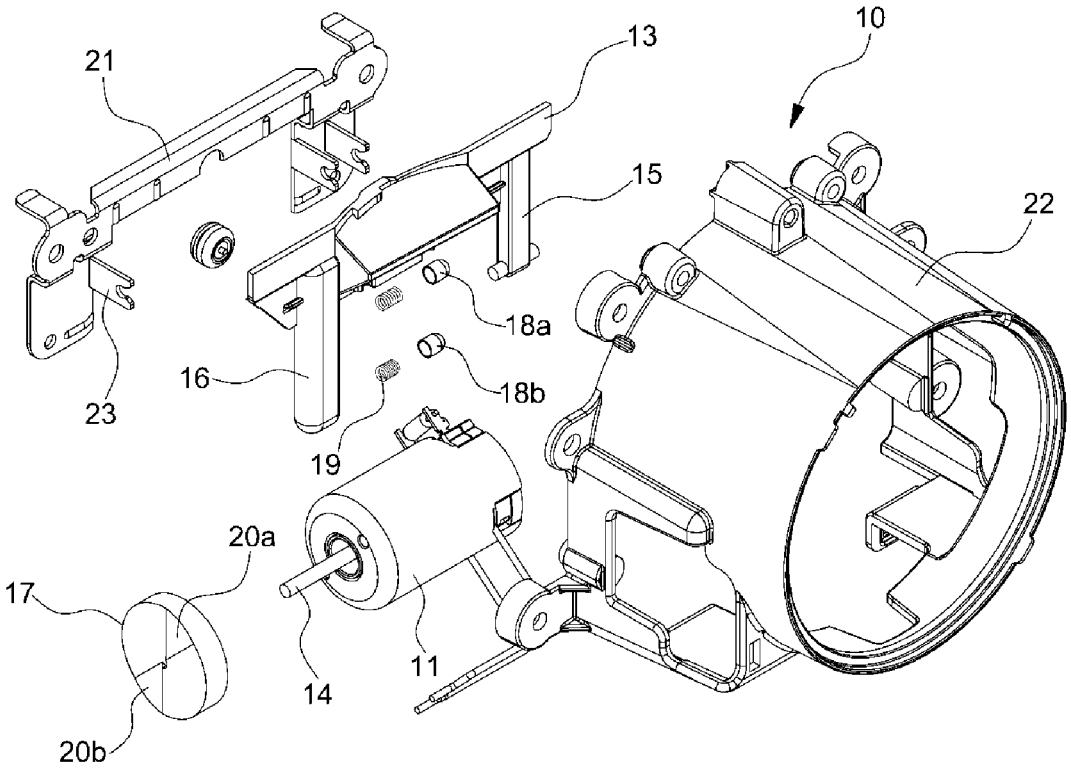
FIG. 2 is an exploded perspective view illustrating the exemplary shield drive device according to the present invention.

FIG. 1 is a combinational perspective view illustrating a shield drive device according to various embodiments of the present invention. FIG. 2 is an exploded perspective view illustrating the shield drive device according to various embodiments of the present invention.

As illustrated in FIGS. 1 and 2, the shield drive device is applied to a lamp assembly 10 including a light source 12, and the like and is configured in a mechanism that prevents noise from being generated by appropriately controlling a shield motion when a shield 13 is opened and closed.

To this end, the shield drive device includes the shield 13 as a mechanism for implementing a high beam and a low beam and the shield 13 is installed in a rotatable structure by using a hinge portion 15 as an axis while being deployed in front of the light source 12 positioned in the lamp assembly 10.

Herein, the hinge portion 15 of the shield 13 may be fastened and supported onto one side of a shield holder 21 by a pin 22.

The shield 13 is driven by an actuator 11 to be described below and while the shield is bent forth or back or erected by rotating around the hinge portion 15, the shield 13 may be opened or closed.

Further, the shield drive device includes the actuator 11 as a mechanism for driving the shield 13.

The actuator 11 may adopt a step motor, or the like and be installed to be supported on a lower end portion of a projection holder 22 while being deployed below the shield 13.

In addition, a shaft 14 of the actuator 11 penetrates and is coupled to a shield arm 16 positioned in the shield and in this case, the end of the shaft 14 may be supported while fitting in a shaft bracket 23 formed in a shield holder 21.

As a result, when a forward or reverse operation of the actuator 11, the shield 13 may be bent forth or erected back together with the rotating shaft 14.

In particular, the actuator 11 is deployed in line below the shield 13, that is, horizontally deployed in line in a horizontal width direction of the lamp assembly 10 to provide rotational drive force in the same direction as the rotational direction of the shield 13.

That is, the axial rotational direction of the actuator 11 and the rotational direction of the shield may be set to the same direction.

Further, the shield drive device includes a sliding contact member 17 as a device for providing friction contact force for controlling the shield motion.

The sliding contact member 17 may have a disk shape and be installed to be fixed on to a front surface of the actuator 11 through a rear surface.

A front surface of the sliding contact member 17 installed as above may be deployed to be close to the shield arm while facing the shield arm 16 positioned in the shield 13.

Of course, the shaft 14 of the actuator 11 just penetrates the center of the sliding contact member 17 to extend forward and thereafter, be coupled to the shield arm.

The sliding contact member 17 serves to provide the friction contact force when the shield rotates.

That is, a sliding stopper 18 to be described below causes friction while contacting the front surface of the sliding contact member 17, and as a result, a moving speed of the shield 13 may be controlled by the contact friction.

Further, the shield drive device substantially includes a stopper 18 and a spring 19 as mechanisms for decelerating and controlling the motion of the shield 13.

The sliding stopper 18 and the spring 19 are mounted to be inserted into a stopper mounted groove 24 formed in the shield arm 16 of the shield 13 to contact the sliding contact member 17 when the shield rotates.

That is, the spring 19 and the sliding stopper 18 are sequentially inserted and mounted from the inside of the stopper mounted groove 24 and a front portion of the sliding stopper 18 protrudes out of the stopper mounted groove 24 to contact the front surface of the sliding contact member 17 just in front thereof.

Herein, the spring 19 continuously exerts force to push the sliding stopper 18 out of the groove while elastically supporting the sliding stopper 18.

In addition, the sliding stopper 18 may be compressed or uncompressed (restored) by a height difference of an inclination surface 20 to be described below while contacting the sliding contact member 17, and as a result, the shield motion speed may be decelerated and controlled by pressed force exerted while the sliding stopper 18 is compressed and restored.

In particular, a plurality of sliding stoppers 18 and springs 19 is provided, for example, two stoppers 18 and springs 19 are provided in an upper and lower sides and the upper sliding stopper 18 serves to control a speed when the shield is opened and the lower sliding stopper 18 serves to control a speed when the shield is closed.

Figure 3:
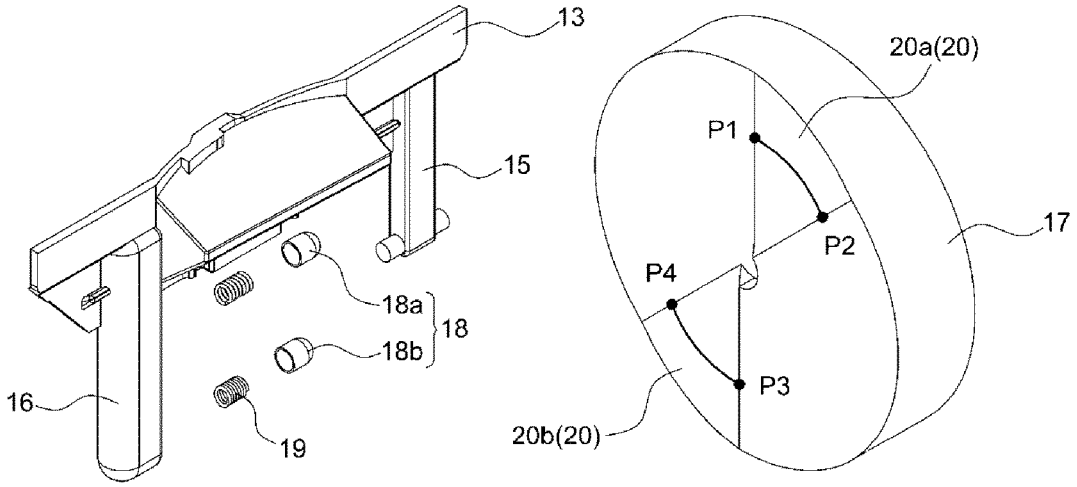
FIG. 3 is a perspective view illustrating a shield, a sliding stopper, a spring, and a sliding contact member in the exemplary shield drive device according to the present invention.

FIG. 3 is a perspective view illustrating a shield, a sliding stopper, a spring, and a sliding contact member in the shield drive device according to various embodiments of the present invention.

As illustrated in FIG. 3, herein, a form of the shield 13 and a form of the sliding contact member 17 are shown.

The shield arm 16 and the bar-shaped hinge portion 15 are vertically formed at both sides of the bottom of a body part of the shield 13 and each of a set of springs 19 and sliding stoppers 18 is mounted in two stopper mounted grooves 24 formed in the shield arm 16.

The hinge portion 15 of the shield 13 is supported on the shield holder through a pin fastening structure and the supported shield 13 may rotate around a lower pin fastening portion of the hinge portion 15 as a center shaft.

Further, the sliding contact member 17 has the disk shape and the inclination surface 20 having a height difference in a circumferential direction is formed on the front surface of the sliding contact member 17.

As a result, while the shield-side sliding stopper 18 is progressed along an inclination surface section, the sliding stopper 18 may be compressed while being pressed by an inclination surface structure which is heightened in a progress direction and consequently, the shield deceleration control may be achieved by the friction force which is strongly exerted while the sliding stopper 18 is compressed.

The inclination surface 20 may be constituted by two inclination surfaces 20*a* and 20*b* having a phase difference of 180° from each other and in this case, the respective inclination surfaces 20*a* and 20*b* may be constituted by inclination surfaces which are gradually heightened in opposite directions to each other based on the circumferential direction.

For example, one inclination surface 20*a* contacted by the upper sliding stopper 18 when the shield is opened may be constituted by an inclination surface which is gradually heightened from a start point P1 to an end point P2 in the circumferential direction.

Further, the other one inclination surface 20*b* contacted by the lower sliding stopper 18 when the shield is closed may be constituted by an inclination surface which is gradually lowered from a start point P3 to an end point P4 in the circumferential direction.

As a result, when the shield is opened and closed, one sliding stopper 18 may be progressed along the inclination surface which is gradually heightened and simultaneously, the other one sliding stopper 18 may be progressed along the inclination surface which is gradually lowered.

Therefore, an operational state of the shield drive device configured as above will be described below.

Figure 4A:
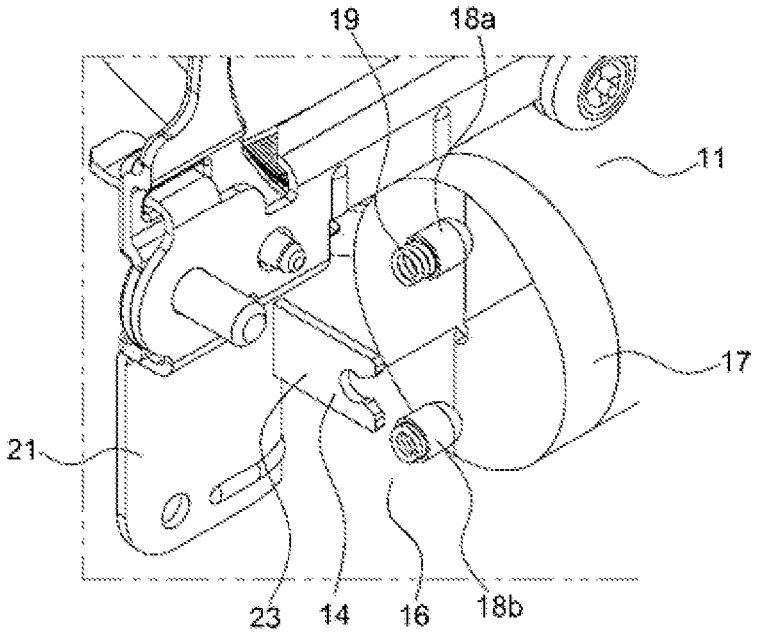
FIG. 4A and FIG. 4B are a perspective view and a cross-sectional view illustrating states of the sliding stopper and the spring when the shield is closed in the exemplary shield drive device according to the present invention.
Figure 4B:
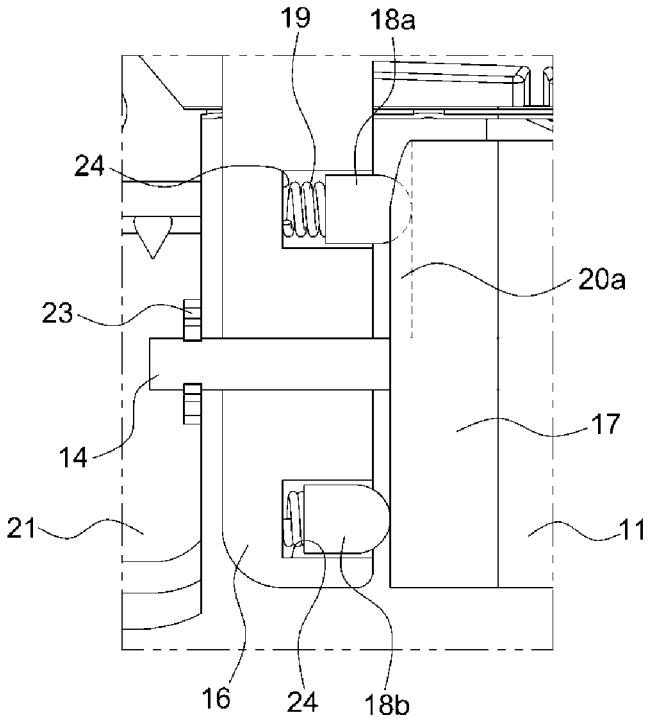
Figure 5A:
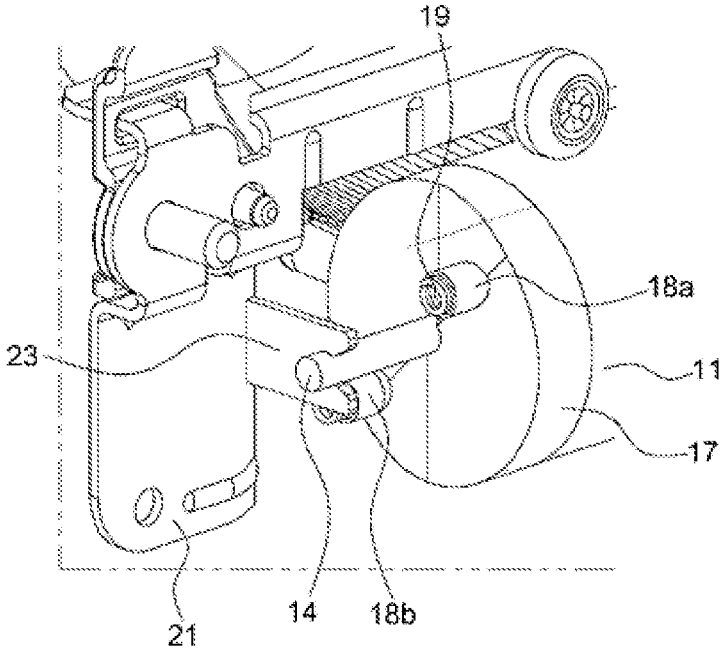
FIG. 5A and FIG. 5B are a perspective view and a cross-sectional view illustrating states of the sliding stopper and the spring when the shield is opened in the exemplary shield drive device according to the present invention.
Figure 5B:
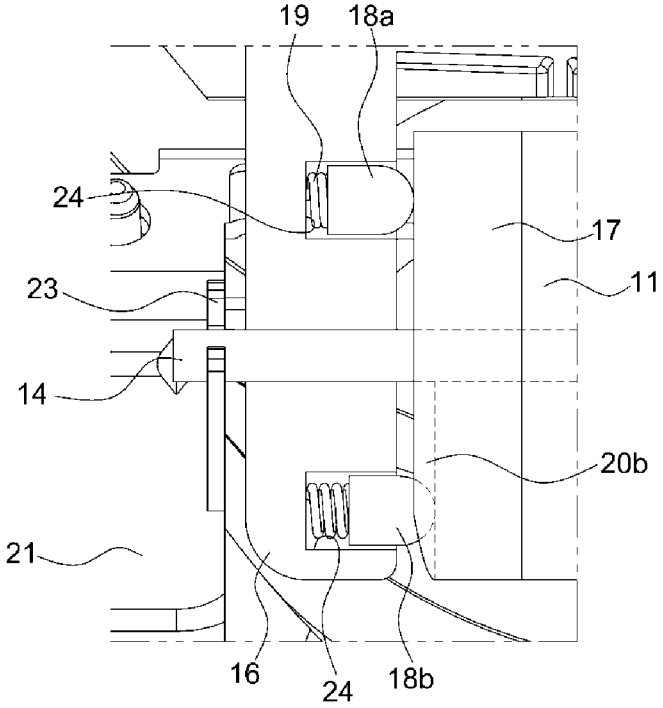
Figure 6:
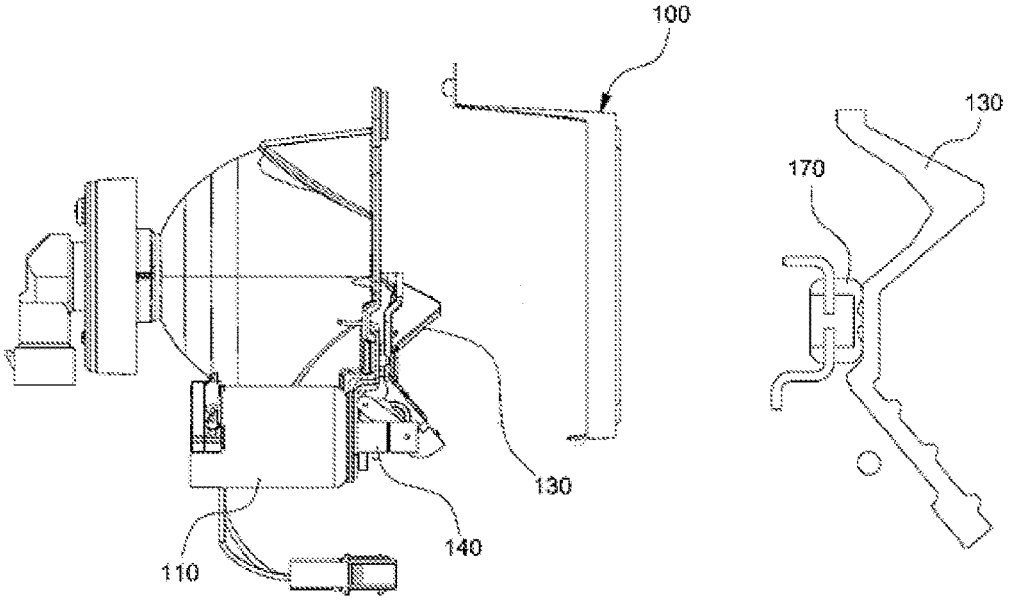
FIG.6 (Related Art)
FIG. 6 and FIG. 7 are a side view and a cross-sectional view illustrating a shield drive device in the related art.
Figure 7:
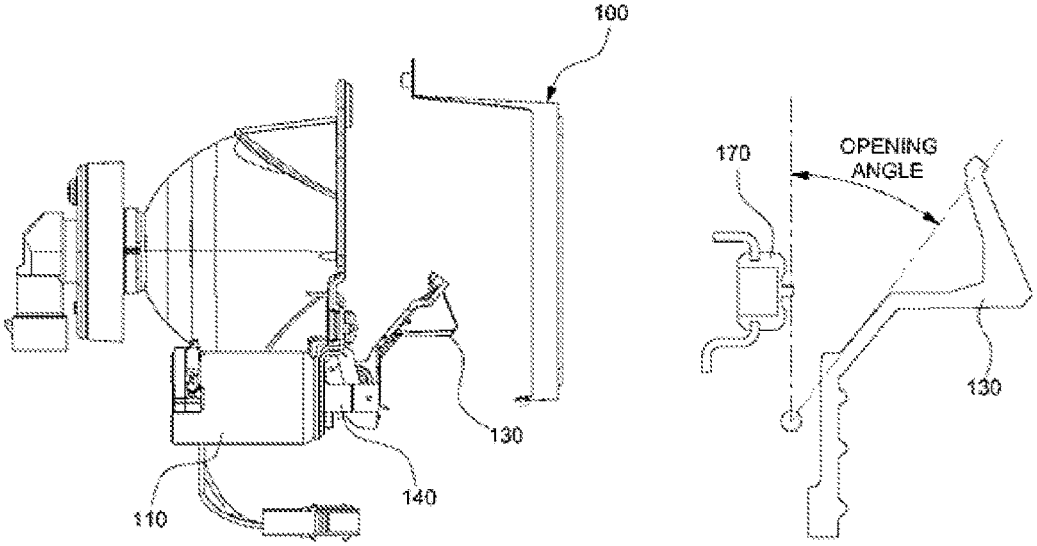
FIG.7 (Related Art)
Figure 8:
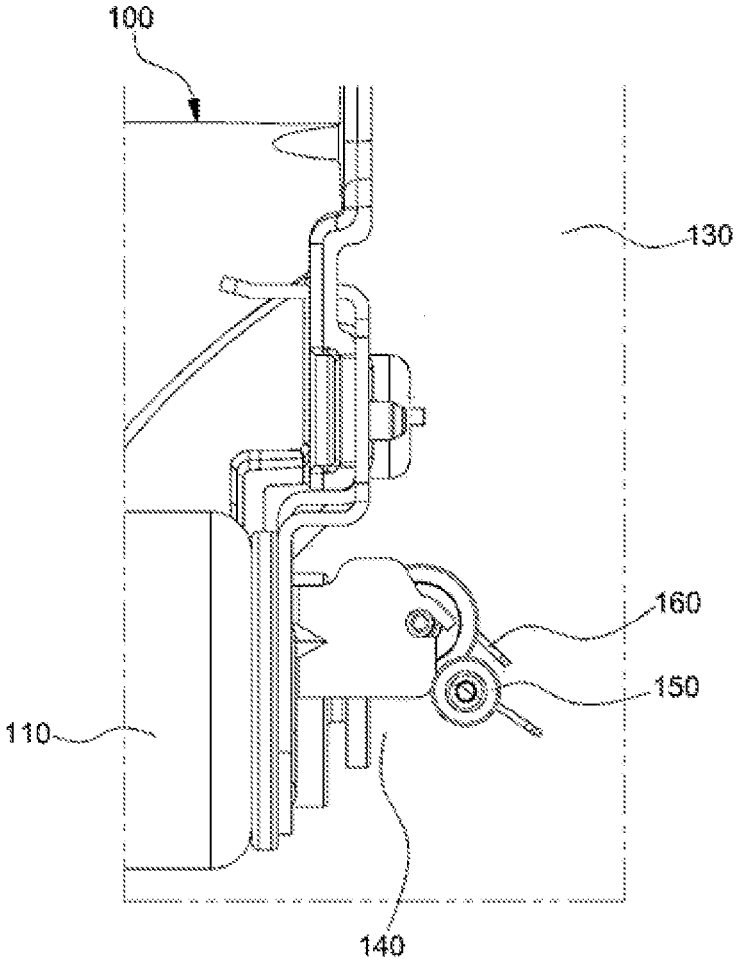
FIG.8 (Related Art)
FIG. 8 and FIG. 9 are enlarged diagrams illustrating a noise generation cause in the exemplary shield drive device in the related art.
Figure 9:
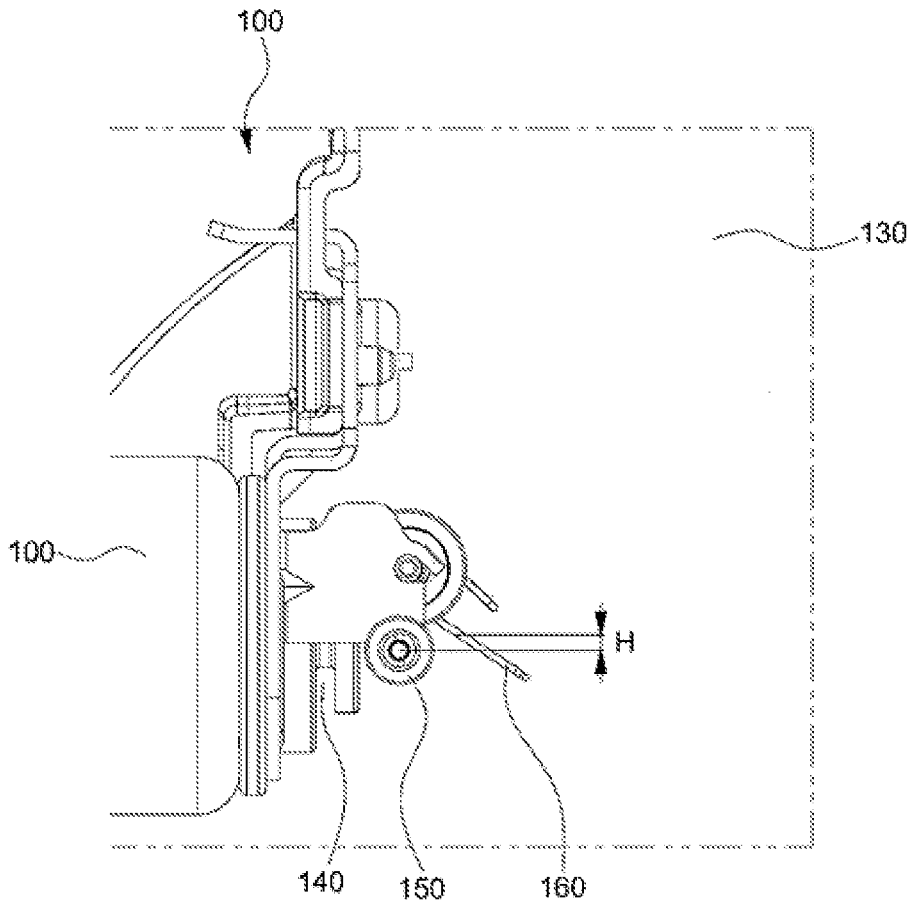
FIG.9 (Related Art)

FIGS. 4A and 4B are a perspective view and a cross-sectional view illustrating a state when the shield is closed in the shield drive device according to various embodiments of the present invention. FIGS. 5A and 5B are a perspective view and a cross-sectional view illustrating a state when the shield is opened in the shield drive device according to various embodiments of the present invention.

As illustrated in FIGS. 4A and 4B and FIGS. 5A and 5B, herein, a shield closing state is a state in which the low beam of the lamp is implemented and a shield opening state is a state in which the high beam of the lamp is implemented.

First, a state when the low-beam state is switched to the high-beam state will be described below.

In the shield closing state, the upper sliding stopper 18*a* is positioned at the start point P1 of the upper inclination surface 20*a* of the sliding contact member 17 and the lower sliding stopper 18*b* is positioned at the start point P3 of the lower inclination surface 20*b*.

In this state, when the shield 13 starts to rotate by driving of the actuator, the upper sliding stopper 18*a* is progressed along the inclination surface 20*a* which is gradually heightened and in this case, the sliding stopper 18*a* is gradually further compressed as the sliding stopper 18*a* comes close to the end point P2 and when the sliding stopper 18*a* is positioned at the end point P2, the sliding stopper 18*a* is maximally compressed.

Simultaneously, the lower sliding stopper 18*b* is progressed along the inclination surface 20*b* which is gradually lowered and in this case, the sliding stopper 18*b* is gradually changed from an initial compression state to a release state as the sliding stopper 18*b* comes close to the end point P4 and when the sliding stopper 18*b* is positioned at the end point P4, the sliding stopper 18*b* is completely restored.

By the gradually increasing contact friction force exerted while the upper sliding stopper is compressed when the shield is opened, the shield is initially rapidly opened when being opened and thereafter, gradually slows down when the shield stops, and as a result, the impact when the shield is opened is reduced and the noise is not generated.

Next, a state when the high-beam state is switched to the low-beam state will be described below.

In the shield opening state, the upper sliding stopper 18*a* is positioned at the end point P2 of the upper inclination surface 20*a* of the sliding contact member 17 and the lower sliding stopper 18*b* is positioned at the end point P4 of the lower inclination surface 20*b*.

In this state, when the shield 13 starts to rotate by the driving of the actuator, the lower sliding stopper 18*b* is progressed along the inclination surface 20*b* which is gradually heightened and in this case, the sliding stopper 18*b* is gradually further compressed as the sliding stopper 18*a* comes close to the start point P3 and when the sliding stopper 18*a* is positioned at the end point P3, the sliding stopper 18*a* is maximally compressed.

Simultaneously, the upper sliding stopper 18*a* is progressed along the inclination surface 20*a* which is gradually lowered and in this case, the sliding stopper 18*a* is gradually changed from the initial compression state to the release state as the sliding stopper 18*a* comes close to the start point P1 and when the sliding stopper 18*a* is positioned at the start point P1, the sliding stopper 18*a* is completely restored.

By the gradually increasing contact friction force exerted while the lower sliding stopper is compressed when the shield is closed, the shield is initially rapidly closed when being closed and thereafter, gradually slows down when the shield stops, and as a result, the impact when the shield is closed is reduced and the noise is not generated.

Meanwhile, the actuator may adopt a step motor without a coil spring (not illustrated) and in this case, while power is not applied, the shield closing state may be maintained by restoration force of the coil spring.

Of course, twisting stress of the coil spring is increased when the shield is opened by driving the step motor depending on the application of the power to store the restoration force.

As such, in the present invention, a shield driving scheme is implemented, in which when the shield is opened, an opening speed of the shield is decelerated and controlled while one sliding stopper is compressed and when the shield is closed, a closing speed of the shield is decelerated and controlled while the other one sliding stopper is compressed to secure shield driving quality such as reducing the generation of the noise when the shield is opened and closed, and the like.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A shield drive device for a head lamp comprising:

a shield deployed in front of a light source positioned in a lamp assembly to be opened and closed while rotating by using a hinge portion as an axis;

an actuator connected to a shield arm through a shaft while being deployed below the shield to rotate the shield;

a sliding contact member including an inclination surface having a height difference in a circumferential direction of the sliding contact member and deployed to be close to the shield arm of the shield to adjust a magnitude of friction contact force when the shield rotates; and a sliding stopper and a spring mounted on the shield arm of the shield and configured to decelerate and control a motion of the shield while being compressed or decompressed while contacting the sliding contact member when the shield rotates.

2. The shield drive device of claim 1, wherein the actuator is deployed in line below the shield to provide rotational drive force in a same direction as a rotational direction of the shield.

3. The shield drive device of claim 1, wherein a plurality of sliding stoppers and springs is provided, at least one of which is configured to decelerate and control a shield motion when the shield is opened and another of which is configured to decelerate and control the shield motion when the shield is closed.

4. The shield drive device of claim 1, wherein the inclination surface having a height difference in a circumferential direction is provided on a front surface of the sliding contact member, and as a result, a shield deceleration control is achieved while the sliding stopper passes through an inclination surface section.

5. The shield drive device of claim 4, wherein the inclination surface of the sliding contact member comprises two inclination surfaces having a phase difference of 180° from each other and which are gradually heightened in opposite directions to each other based on the circumferential direction.

6. The shield drive device of claim 1, wherein an inclination surface of the sliding contact member comprises two inclination surfaces having a phase difference of 180° from each other and which are gradually heightened in opposite directions to each other based on a circumferential direction.

* * * * *